United States Patent [19]

Edmark

[11] 4,193,407

[45] Mar. 18, 1980

[54] PACIFIER

[75] Inventor: Ove Edmark, Sandviken, Sweden

[73] Assignee: Per A. Ljungberg, Corona Del Mar, Calif.

[21] Appl. No.: 867,776

[22] Filed: Jan. 9, 1978

[30] Foreign Application Priority Data

Oct. 28, 1977 [SE] Sweden ..... 7712191

[51] Int. Cl.[2] ..... A61J 17/00

[52] U.S. Cl. ..... 128/360

[58] Field of Search ..... 128/252, 359, 360; 215/11 R; 119/71

[56] References Cited

U.S. PATENT DOCUMENTS

| | | | |
|---|---|---|---|
| 1,656,833 | 1/1928 | Schutze | 128/359 |
| 2,612,165 | 9/1952 | Szuderski | 128/360 |
| 2,860,639 | 11/1958 | Hoover | 128/359 |
| 2,889,829 | 6/1959 | Tannenbaum | 128/252 |
| 3,610,248 | 10/1971 | Davidson | 128/252 X |

FOREIGN PATENT DOCUMENTS

| | | | |
|---|---|---|---|
| 561220 | 8/1958 | Canada | 128/360 |
| 906612 | 3/1954 | Fed. Rep. of Germany | 128/359 |
| 1120990 | 4/1956 | France | 128/359 |
| 411222 | 6/1934 | United Kingdom | 128/360 |
| 1435302 | 5/1976 | United Kingdom | 128/360 |

*Primary Examiner*—Richard J. Apley
*Attorney, Agent, or Firm*—William C. Babcock

[57] ABSTRACT

A baby pacifier of the type that includes a hollow resilient nipple and a ring-shaped handle that extend outwardly in opposite directions from a substantially rigid disc that has a diameter of sufficient magnitude to prevent the disc entering the child'mouth. The nipple contains a non-toxic material, for example table salt, that has a disagreeable taste and a non-toxic dye. Upon a baby biting through the nipple, the non-toxic material subjects him to a disagreeable taste, and the baby rejects the pacifier.

10 Claims, 6 Drawing Figures

FIG. 1
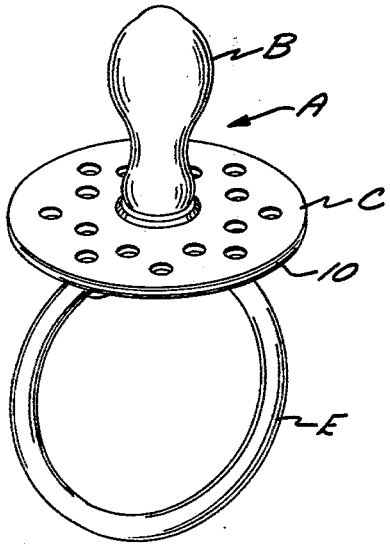
FIG. 2
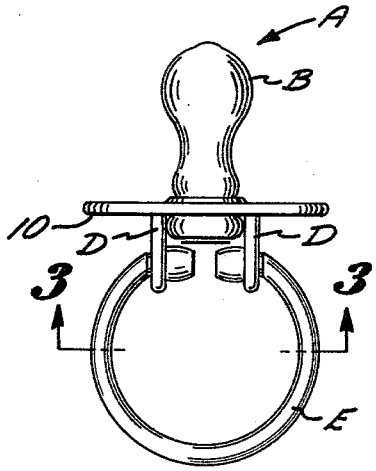
FIG. 3
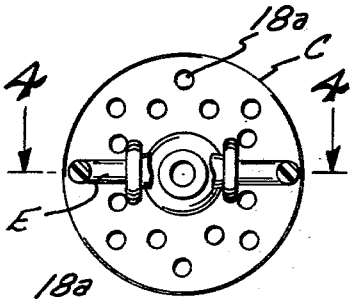
FIG. 4
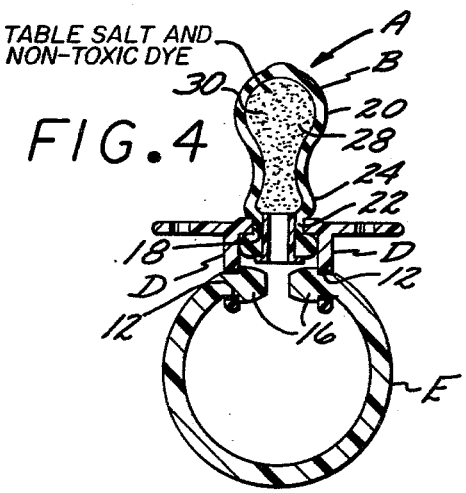
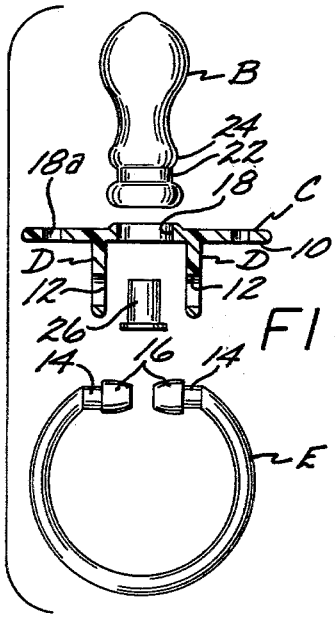
FIG. 6
FIG. 5
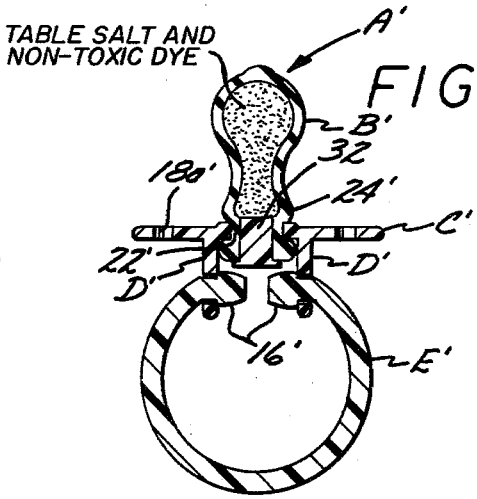

PACIFIER

CROSS-REFERENCE TO RELATED APPLICATION

Swedish patent application Ser. No. 771219, 11 filed Oct. 28, 1977 in the Sweden Patent Office.

SUMMARY OF THE INVENTION

A baby's pacifier that includes a rigid disc of sufficient size as to not be insertable in the child's mouth, with the disc having a handle projecting outwardly from a first side, and a hollow nipple from the second side.

The nipple contains a material such as table salt that has a disagreeable taste and that will cause the baby to reject the pacifier if the baby severs a portion of the nipple from the disc. The nipple preferably has a non-toxic dye on the interior thereof that will mix with the baby's saliva when the nipple is partially severed and visually indicate to the mother that the pacifier, or at least the nipple thereof, should be replaced with one that does not have a partially severed nipple.

A baby that is using a pacifier with a nipple that is partially severed may complete the severance, and swallow or choke on the severed nipple portion. When the material of disagreeable taste is table salt, the salt not only serves the function of causing the baby to reject the pacifier when the nipple is partially severed but the salt also tends to prevent the growth of harmful bacteria within the nipple.

A major object of the present invention is to provide a pacifier that will not only cause a baby to reject the same when the nipple thereof is partially severed, but will also visually indicate to the mother than the nipple is unsatisfactory for further use, and the material used in the interior of the nipple to create a disagreeable taste not only serving this function but also preventing the growth of harmful bacteria within the interior of the nipple.

BRIEF DESCRIPTION OF THE DRAWINGS

FIG. 1 is a perspective view of the pacifier;

FIG. 2 is a side elevational view of the device shown in FIG. 1;

FIG. 3 is a top plan view of the device;

FIG. 4 is a longitudinal cross-sectional view of a first form of the device taken on the line 4—4 of FIG. 3;

FIG. 5 is a longitudinal cross-sectional view of a second form of the device; and FIG. 6 is an exploded view of the components that comprise the device.

DESCRIPTION OF THE PREFERRED EMBODIMENT

A first form A of a pacifier is shown in FIGS. 1–4 that causes a baby (not shown) to reject the same when a nipple B that forms a part thereof is partially severed. The pacifier A includes a rigid disc C that is of sufficient size that a baby cannot place the same within his mouth.

The disc is preferably formed from a light weight rigid material such as a polymerized resin, and includes a first side 10 from which a pair of spaced brackets D project. The brackets D include axially aligned apertures 12 that pivotally engage end potions 14 of a ring-shaped handle E. The adjacent end extremities 16 of end portions 14 are transversely expanded to prevent separation of handle E from brackets D.

The nipple B is formed from a soft resilient material and includes a hollow bulb that develops into a tubular neck 24 in which a circular recess 22 is defined.

When neck 24 is inserted in a centered opening 18 in disc C, and a tubular expander 26 moved longitudinally in neck 24 to the position shown in FIG. 4, the recess 22 is transversely expanded into gripping contact with disc C. Expander 26 has a longitudinal bore 26*a* therein. Disc C is lightened by having a number of spaced openings 18*a* therein.

When the pacifier A is disposed with the nipple B in a downward position an aqueous solution containing a non-toxic material such as common table salt and a non-toxic dye is introduced into the bulb 20 through the bore 26*a* and allowed to dry as a film on the interior surface of the bulb. The time for drying may be lessened by heating the pacifier A to cause vaporization of the water in the solution, with the vapor escaping through the bore 26*a*. The water soluble material 28 and dye 30 are shown as a film on the interior surface of nipple B in FIG. 4. When a baby (not shown) bites through a portion of the nipple B, the baby's saliva will mix with the material 28, and due to the disagreeable taste of the latter the baby will reject the pacifier A. Concurrently the dye 30 will mix with the baby's saliva, and the area around his mouth will be colored to visually indicate to the baby's mother that the nipple B is no longer satisfactory and must be replaced. No non-toxic dye has been specified, as any dye that has been approved for food products may be used in the invention for the above-described purpose.

A second form of pacifier A′ is shown in FIG. 5, that is similar to first form A, but does not employ the tubular expander 26. Elements of the second form A′ that are common to the first form A are identified by the numerals and letters previously used but with primes added thereto.

In the second form A′, a concentrated aqueous saline solution 34 is injected into the interior of nipple B to partially fill the same, and this solution containing a non-toxic dye. The expander 26 is replaced by a solid expander 34 to maintain the solution 34 within the nipple. When a baby (not shown) severs a portion of the nipple B′, the baby will immediately taste the bitter saline solution 34 and reject the pacifier A′. The area around the baby's mouth will be colored by the dye in the same manner as when the first form A of the invention is used.

The use and operation of the invention has been described previously in detail and need not be repeated.

What is claimed is:

1. A baby pacifier of the type that includes a resilient nipple having a bulb that develops into a tubular neck, a rigid disc that has said nipple projecting from one side thereof, a handle, and means for supporting said handle from an opposite side of said disc, said pacifier being characterized by said nipple having a non-toxic material therein having a sufficiently disagreeable taste that a baby will reject said pacifier when the baby bites through said nipple and said non-toxic material mixes with the saliva of the baby.

2. A baby pacifier as defined in claim 1 in which said non-toxic material is in the form of a dry layer on the interior of said nipple.

3. A baby pacifier as defined in claim 2 in which said layer contains table salt.

4. A baby pacifier as defined in claim 3 in which said table salt is present in a sufficient amount as to prevent any substantial growth of bacteria in said nipple.

5. A baby pacifier as defined in claim 2 in which said layer in addition includes a non-toxic dye, with said dye mixing with the saliva of a baby after the latter bites through said nipple, and colored saliva visually indicating that said nipple is no longer suitable for use as a part of said pacifier.

6. A baby pacifier as defined in claim 1 in which said disc has a centered opening therein and said nipple has said tubular neck disposed in said opening, and said pacifier in addition including an expander insertable in said neck to transversely expand the same into engagement with the portion of said disc surrounding said opening.

7. A baby pacifier as defined in claim 6 in which said expander has a longitudinal bore therein through which an aqueous solution of said material may be introduced into said nipple to subsequently be dried to define said film.

8. A baby pacifier as defined in claim 7 in which said expander is solid and seals with said bore, and said material is present in said nipple as an aqueous solution thereof that mixes with the saliva of said baby when the baby bites through said nipple.

9. A baby pacifier as defined in claim 8 in which said material is table salt.

10. A baby pacifier as defined in claim 8 in which said solution contains a non-toxic dye.

* * * * *